United States Patent [19]

Burgin

[11] Patent Number: 5,044,795

[45] Date of Patent: Sep. 3, 1991

[54] WRAP BRAKE SPRING FOR THE TAKE-OFF CORE OF AN INKED RIBBON CARTRIDGE

[75] Inventor: Markus Burgin, Uster, Switzerland

[73] Assignee: Pelikan, Inc., Franklin, Tenn.

[21] Appl. No.: 400,358

[22] Filed: Aug. 30, 1989

[51] Int. Cl.[5] ..... B41J 33/14

[52] U.S. Cl. ..... 400/234; 400/208; 400/242

[58] Field of Search ..... 400/242, 247, 234, 618; 242/75.4, 75.43, 156, 156.1, 156.2

[56] References Cited

U.S. PATENT DOCUMENTS

| | | | |
|---|---|---|---|
| 4,013,160 | 3/1977 | Colecchi | 400/234 |
| 4,147,439 | 4/1979 | Colecchi | 400/208 |
| 4,347,008 | 8/1982 | Jagodzinski et al. | 400/242 |
| 4,456,193 | 6/1984 | Westover | 242/75.43 |
| 4,684,272 | 8/1987 | Watanabe | 400/242 |
| 4,780,011 | 10/1988 | Hasegawa et al. | 400/242 |

*Primary Examiner*—Edgar S. Burr
*Assistant Examiner*—Ren Yan
*Attorney, Agent, or Firm*—John F. A. Earley; John F. A. Earley, III

[57] ABSTRACT

The spring (6) has two radially aligned legs (7, 8) and a circular-segment-shaped web (9) connecting the legs. The web (9) is inserted with initial stress in a circumferential groove (10) of an unwinding core (3). The free end of the leg rests against a stop (11). The free end of the leg (8) is bent at a right angle. The right-angle bend forms a deflecting organ (12), around which the ribbon (5) is fed. The surface of the spring (6) is roughened and abrasive at least in the area of the web (9). The spring (6) is preferably phosphatized for this purpose. By means of this design, a uniform ribbon tension over the entire running time of the ribbon is achieved.

10 Claims, 1 Drawing Sheet

WRAP BRAKE SPRING FOR THE TAKE-OFF CORE OF AN INKED RIBBON CARTRIDGE

Figure 1:
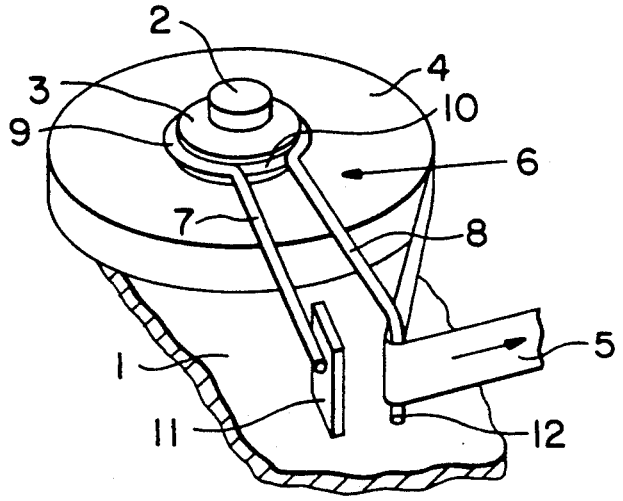

A wrap brake spring in accordance with the preamble of claim 1 is known from the IBM TECHNICAL DISCLOSURE BULLETIN, Vol. 18, No. 4 (Sept. 1975), p. 1093. This spring has two legs and a circular-segment-shaped web connecting the legs, which wraps around the unwinding core. The free end of one leg is held in the housing. The free end of the other leg is bent at a right angle and with the right-angle bend forms a deflecting organ for the ribbon. When there is tension on the ribbon, a force is exerted on the deflecting organ, which releases the brake. The unwinder turns as a result and the ribbon is transported. This wrap brake has several advantages. It can be designed to be self-locking, so that it is a good transport lock. In addition, it at the same time holds the ribbon elastically under tension. A disadvantage of the known wrap brakes of this type is above all the fact that the ribbon tension increases towards the end of the ribbon.

The present invention is based on the problem of developing a spring band brake of the type described above so that the ribbon tension remains more constant over the ribbon length. This problem is solved by the characterizing features of claim 1.

By means of the desing of the spring according to the invention, the groove in which the web of the spring lies becomes somewhat worn down in operation, so that the contact radius of the spring is somewhat reduced and the spring relaxed. The force for releasing the brake thereby decreases towards the end of the ribbon. Thus the tendency for an increase in ribbon tension is counteracted.

An embodiment of the invention is explained below with reference to the drawing. The following is shown in it:

FIG. 1 a perspective view of a part of a ribbon cartridge, and

Figure 2:
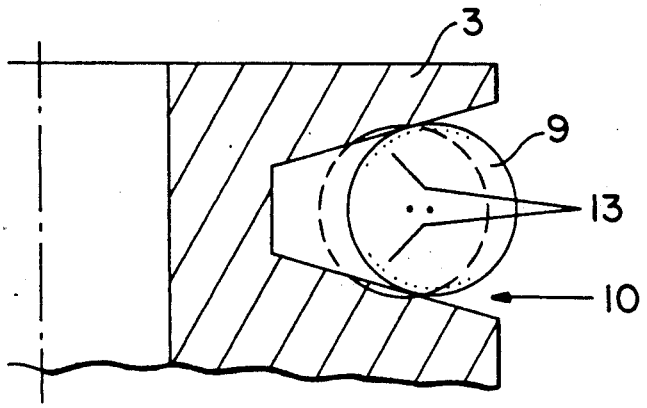

FIG. 2 an axial section through the unwinding core on an enlarged scale.

FIG. 1 shows in perspective only the part of a ribbon cartridge relevant for the invention, for the purpose of a better overview. The cartridge has a housing 1, which has a shaft 2. The core 3 of an unwinder 4 rests on the shaft 2 so as to be rotatable. The film ribbon 5 is drawn off from the unwinder 4. A wrap brake spring 6 made of round spring steel wire brakes the core 3. The spring 6 has two legs 7, 8 protruding approximately radially to the shaft 2 and a circular-segment-shaped web 9 connecting the legs 7, 8 with a angle of wrap ranging between 180° and 360°. The web 9 is inserted in a wedge-shaped circumferential groove 10 of the core 3 with initial stress. The free end of the leg 7 is held back by a stop 11 that is fixed to the housing. The free end of leg 8 is bent 90° so that in operation it is more or less parallel to the shaft 2. The right-angle bend forms a deflecting organ 12 around which the ribbon 5 is fed. The tension of the ribbon 5 exerts a force on the deflecting organ 12, which spreads the legs 7, 8 and thus releases the brake. The surface of the spring 6 is roughened and abrasive at least in the area 13 in which the web 9 lies in the groove 10. An especially effective process for roughening the surface is phosphatizing. By this means it is possible to achieve at the same time not only the desired slightly abrasive surface but also corrosion protection. The surface roughness, however, can also be produced by sand-blasting, chemical etching, or plasma spraying using non-metallic particles (sputtering). Mechanical stamping, which results in a file-type structure, is also possible. An abrasive surface can also be achieved by coating with abrasive grain and a binder.

During assembly the web 9 lies against the tapered side walls of the groove 10. The friction due to the initial tension on the spring 6 is somewhat higher than with a smooth spring. When the core 3 turns in operation, its contact surface is successively abraded somewhat so that towards the end of the ribbon the contact radius is somewhat reduced (shown in FIG. 2 by the broken line). By this means the initial stress of the spring 6 and thus the braking force is reduced. In this way it is possible to compensate for the otherwise hardly avoidable increase in ribbon tension towards the end of the ribbon. The ribbon tension remains virtually constant over the entire ribbon lenght. Thus reliabile operation of the cartridge can be guaranteed. In addition, this makes it possible to select a greater manufacturing tolerance so that the spring 6, in particular, can be manufactured more cheaply in spite of the expense for the surface treatment. The materials ABS, SB or PS (acrylbutadiene-styrene, styrene-butadiene or standard polystyrene), in particular, have proved to be suitable materials for the core 3 in interaction with the abrasive surface of the spring 6.

I claim:

1. A wrap brake spring for braking an unwinding core of a ribbon cartridge, comprising a circular-shaped web segment which rests against the unwinding core and has an angle of wrap between 180° and 360°, a first leg attached to a first end of the circular-shaped web segment and extending radially outwardly therefrom, a second leg attached to a second end of the circular-shaped web segment and extending radially outwardly therefrom, the first leg having a free end, the free end of the first leg being retained in a predetermined position, the second leg having a free end, the free end of the second leg having a deflecting organ around which a ribbon is adapted to pass so that when tension is exerted on the ribbon, the ribbon exerts a force on the deflecting organ, which spreads the first leg and second leg and releases the wrap brake spring, allowing the unwinding core to rotate, and means for removing sufficient material from the core so that, as the unwinding core continues to rotate, the contact radius of the circular-shaped web segment is reduced and the braking force of the wrap brake spring is reduced to prevent an increase in ribbon tension towards the end of the ribbon, said means including abrasion means formed on the surface of the wrap brake spring at least in a contact area where the circular-shaped web segment contacts the unwinding core for abrading the unwinding core as the unwinding core is rotated.

2. A wrap brake spring for braking an unwinding core of a ribbon cartridge, comprising a circular-shaped web segment which rests against the unwinding core and has an angle of wrap between 180° and 360°, a first leg attached to a first end of the circular-shaped web segment and extending radially outwardly therefrom, a second leg attached to a second end of the circular-shaped web segment and extending radially outwardly therefrom, the first leg having a free end, the free end of the first leg being retained in a predetermined position, the second leg having a free end, the free end of the second leg having a deflecting organ around which a ribbon is adapted to pass so that when tension is exerted on the ribbon, the ribbon exerts a force on the deflecting organ, which spreads the first leg and second leg and releases the wrap brake spring, allowing the unwinding core to rotate, and abrasion means formed on the surface of the wrap brake spring at least in a contact area where the circular-shaped web segment contacts the unwinding core for abrading the unwinding core as the unwinding core is rotated to prevent an increase in ribbon tension towards the end of the ribbon, the abrasion means being a phosphatized surface formed on the surface of the circular-shaped web segment by phosphatizing.

3. A wrap brake spring for braking an unwinding core of a ribbon cartridge, comprising a circular-shaped web segment which rests against the unwinding core and has an angle of wrap between 180° and 360°, a first leg attached to a first end of the circular-shaped web segment and extending radially outwardly therefrom, a second leg attached to a second end of the circular-shaped web segment and extending radially outwardly therefrom, the first leg having a free end, the free end of the first leg being retained in a predetermined position, the second leg having a free end, the free end of the second leg having a deflecting organ around which a ribbon is adapted to pass so that when tension is exerted on the ribbon, the ribbon exerts a force on the deflecting organ, which spreads the first leg and second leg and releases the wrap brake spring, allowing the unwinding core to rotate, and abrasion means formed on the surface of the wrap brake spring at least in a contact area where the circular-shaped web segment contacts the unwinding core for abrading the unwinding core as the unwinding core is rotated to prevent an increase in ribbon tension towards the end of the ribbon, the abrasion means being a sand-blasted surface formed on the surface of the circular-shaped web segment by sandblasting.

4. A wrap brake spring for braking an unwinding core of a ribbon cartridge, comprising a circular-shaped web segment which rests against the unwinding core and has an angle of wrap between 180° and 360°, a first leg attached to a first end of the circular-shaped web segment and extending radially outwardly therefrom, a second leg attached to a second end of the circular-shaped web segment and extending radially outwardly therefrom, the first leg having a free end, the free end of the first leg being retained in a predetermined position, the second leg having a free end, the free end of the second leg having a deflecting organ around which a ribbon is adapted to pass so that when tension is exerted on the ribbon, the ribbon exerts a force on the deflecting organ, which spreads the first leg and second leg and releases the wrap brake spring, allowing the unwinding core to rotate, and abrasion means formed on the surface of the wrap brake spring at least in a contact area where the circular-shaped web segment contacts the unwinding core for abrading the unwinding core as the unwinding core is rotated to prevent an increase in ribbon tension towards the end of the ribbon, the abrasion means being a plasma-sprayed surface formed on the surface of the circular-shaped web segment by plasma-spraying the surface with nonmetallic particles.

5. A wrap brake spring for braking an unwinding core of a ribbon cartridge, comprising a circular-shaped web segment which rests against the unwinding core and has an angle of wrap between 180° and 360°, a first leg attached to a first end of the circular-shaped web segment and extending radially outwardly therefrom, a second leg attached to a second end of the circular-shaped web segment and extending radially outwardly therefrom, the first leg having a free end, the free end of the first leg being retained in a predetermined position, the second leg having a free end, the free end of the second leg having a deflecting organ around which a ribbon is adapted to pass so that when tension is exerted on the ribbon, the ribbon exerts a force on the deflecting organ, which spreads the first leg and second leg and releases the wrap brake spring, allowing the unwinding core to rotate, and abrasion means formed on the surface of the wrap brake spring at least in a contact area where the circular-shaped web segment contacts the unwinding core for abrading the unwinding core as the unwinding core is rotated to prevent an increase in ribbon tension towards the end of the ribbon, the roughness of the abrasion means being increased by a mechanical stamp by mechanically stamping the surface of the circular-shaped web segment.

6. A wrap brake spring for braking an unwinding core of a ribbon cartridge, comprising a circular-shaped web segment which rests against the unwinding core and has an angle of wrap between 180° and 360°, a first leg attached to a first end of the circular-shaped web segment and extending radially outwardly therefrom, a second leg attached to a second end of the circular-shaped web segment and extending radially outwardly therefrom, the first leg having a free end, the free end of the first leg being retained in a predetermined position, the second leg having a free end, the free end of the second leg having a deflecting organ around which a ribbon is adapted to pass so that when tension is exerted on the ribbon, the ribbon exerts a force on the deflecting organ, which spreads the first leg and second leg and releases the wrap brake spring, allowing the unwinding core to rotate, and abrasion means formed on the surface of the wrap brake spring at least in a contact area where the circular-shaped web segment contacts the unwinding core for abrading the unwinding core as the unwinding core is rotated to prevent an increase in ribbon tension towards the end of the ribbon, the surface of the circular-shaped web segment being coated with an abrasive grain and a binder.

7. A ribbon cartridge comprising a cartridge housing, an unwinding core mounted in the cartridge housing, said unwinding core having a circumferential groove formed therein, a wrap brake spring for braking the unwinding core comprising a circular-shaped web segment disposed in the circumferential groove and having an angle of wrap between 180° and 360°, a first leg attached to a first end of the circular-shaped web segment and extending radially outwardly therefrom, a second leg attached to the second end of the circular-shaped web segment and extending radially outwardly therefrom, the first leg having a free end, the free end of the first leg resting against a stop in the cartridge housing, the second leg having a free end, the free end of the second leg having a deflecting organ around which a ribbon is adapted to pass so that when tension is exerted on the ribbon, the ribbon exerts a force on the deflecting organ which spreads the first leg and second leg and releases the wrap brake spring, allowing the unwinding core to rotate, and means for removing sufficient material from the core so that, as the unwinding core continues to rotate, the contact radius of the circular-shaped web segment is reduced and the braking force of the wrap brake spring is reduced to prevent an increase in ribbon tension towards the end of the ribbon, said means including abrasion means formed on the surface of the wrap brake spring at least in a contact area where the circular-shaped web segment contacts the unwinding core for abrading the unwinding core as the unwinding core is rotated.

8. The ribbon cartridge of claim 7, wherein the unwinding core consists of acryl-butadiene-styrene, styrene-butadiene or standard polystyrene.

9. A wrap brake spring for braking an unwinding core of a ribbon cartridge, comprising a circular-shaped web segment which rests against the unwinding core and has an angle of wrap between 180° and 360°, a first leg attached to a first end of the circular-shaped web segment and extending radially outwardly therefrom, a second leg attached to a second end of the circular-shaped web segment and extending radially outwardly therefrom, the first leg having a free end, the free end of the first leg being retained in a predetermined position, the second leg having a free end, the free end of the second leg having a deflecting organ around which a ribbon is adapted to pass so that when tension is exerted on the ribbon, the ribbon exerts a force on the deflecting organ, which spreads the first leg and second leg and releases the wrap brake spring, allowing the unwinding core to rotate, and abrasion means formed on the surface of the wrap brake spring at least in a contact area where the circular-shaped web segment contacts the unwinding core for abrading the unwinding core as the unwinding core is rotated to prevent an increase in ribbon tension towards the end of the ribbon, the abrasive means being selected from the group consisting of a phosphatized surface formed on the surface of the circular-shaped web segment by phosphatizing, a sand-blasted surface formed on the surface of the circular-shaped web segment by sandblasting, a plasma-sprayed surface formed on the surface of the circular-web segment by plasma-spraying the surface with non-metallic particles, a mechanically stamped surface formed on the surface of the circular-shaped web segment by mechanically stamping, and an abrasive surface formed on the surface of the circular-shaped web segment by coating with an abrasive grain and a binder.

10. A ribbon cartridge comprising a cartridge housing, an unwinding core mounted in the cartridge housing, said unwinding core having a circumferential groove formed therein, a wrap brake spring for braking the unwinding core comprising a circular-shaped web segment disposed in the circumferential groove and having an angle of wrap between 180° and 360°, a first leg attached to a first end of the circular-shaped web segment and extending radially outwardly therefrom, a second leg attached to the second end of the circular-shaped web segment and extending radially outwardly therefrom, the first leg having a free end, the free end of the first leg resting against a stop in the cartridge housing, the second leg having a free end, the free end of the second leg having a deflecting organ around which a ribbon is adapted to pass so that when tension is exerted on the ribbon, the ribbon exerts a force on the deflecting organ which spreads the first leg and second leg and releases the wrap brake spring, allowing the unwinding core to rotate, and abrasion means formed on the surface of the wrap brake spring at least in a contact area where the circular-shaped web segment contacts the unwinding core for abrading the unwinding core as the unwinding core is rotated to prevent an increase in ribbon tension towards the end of the ribbon, the unwinding core consisting of acryl-butadienestyrene, styrene-butadiene or standard polystyrene, the abrasive means being selected from the group consisting of a phosphatized surface formed on the surface of the circular-shaped web segment by phosphatizing, a sand-blasted surface formed on the surface of the circular-shaped web segment by sandblasting, a plasma-sprayed surface formed on the surface of the circular-web segment by plasma-spraying the surface with non-metallic particles, a mechanically stamped surface formed on the surface of the circular-shaped web segment by mechanically stamping, and an abrasive surface formed on the surface of the circular-shaped web segment by coating with an abrasive grain and a binder.

* * * * *